United States Patent [19]

Sato

[11] 4,119,280

[45] Oct. 10, 1978

[54] CORE FOR ROLLED LABEL STRIP

[75] Inventor: Yo Sato, Tokyo, Japan

[73] Assignee: Kabushiki Kaisha Sato Kenkyusho, Tokyo, Japan

[21] Appl. No.: 792,685

[22] Filed: May 2, 1977

[30] Foreign Application Priority Data

May 7, 1976 [JP] Japan ..... 51-056699

[51] Int. Cl.[2] ..... B65H 75/02

[52] U.S. Cl. ..... 242/68.5

[58] Field of Search ..... 242/68.5, 68, 68.1, 242/68.2, 68.3; 403/2, 290, 359

[56] References Cited

U.S. PATENT DOCUMENTS

| | | | |
|---|---|---|---|
| 2,676,765 | 4/1954 | Kaplan | 242/68.5 |
| 3,623,394 | 11/1970 | Paine | 403/2 |
| 3,860,191 | 1/1975 | Geri | 242/68.5 |
| 4,012,155 | 3/1977 | Morris | 403/290 |

*Primary Examiner*—Edward J. McCarthy
*Attorney, Agent, or Firm*—Ostrolenk, Faber, Gerb & Soffen

[57] ABSTRACT

A core for supporting a rolled label strip which can be quite easily attached to and detached from the core supporting device of a label printing and applying machine without being released during the use of the machine. The core comprises: an attaching section formed in a first end face of a cylindrical body and provided with an inner bore, raised faces formed on the first end face, fitting recesses formed on a second end face, ribs for engaging with a mandrel, formed on the inner wall surface of the cylindrical body in the direction parallel to the axis of the cylindrical body, and a plurality of grooves formed in the inner wall surface of the cylindrical body in the direction parallel to the axis of the cylindrical body.

22 Claims, 8 Drawing Figures

CORE FOR ROLLED LABEL STRIP

BACKGROUND OF THE INVENTION (1) Field of the Invention

This invention relates to a core for a rolled label strip. More particularly, the invention relates to the improvement in a core for winding a label strip thereon, which core is attached to the core supporting device of a label printing and applying machine or the like.

(2) Description of the Prior Art

The tape-like label strip generally comprises a tape-like label being applied with adhesive on its rear side and a tape-like backing strip, which are longitudinally joined together in layers, and only the tape-like label on the backing strip is cut into small pieces of label units. This tape-like label strip is wound round a cylindrical core. The core carrying the label strip is generally attached to a supporting device which is formed inside the machine frame or on the extension of machine frame of a label printing and applying machine.

By continually operating the label printing and applying machine, the attached tape-like label strip is moved forth in the machine from the supporting device, and the printing, peeling and applying of the label units are repeated one by one. When the rolled label strip on the core is used up, the core is detached from the supporting device and the core of a new rolled label strip is attached to the supporting device of the label printing and applying machine to use it again.

The typical core in the conventional art is generally cylindrical and provided with a circular attaching section on one side of the core. The inner diameter of the attaching section is made smaller than that of the inner wall surface of the cylindrical body. On the periphery of one end face are formed a plurality of raised end faces and arcuate recesses in adjoining relation. On the other end face of the cylindrical body, a plurality of recesses are formed.

In the conventional supporting device for supporting the above core of a label strip, a core supporting member is rotatably fitted to an arm plate that is formed on a label printing and applying machine. The inside surface of the core supporting member is provided with a plurality of resilient tabs arranged in a circle. Each resilient tab is provided with a ridge-shaped engaging projection on its outside. The inner circular edge of the attaching section of the core is fitted to the resilient tabs of the supporting device and the core is then pushed forth so as to be attached. With this operation, the inner surface of the attaching section of the core ride over the engaging projections of the resilient tabs and the tabs are bent inward. After this action, the resilient tabs restore their original postures by their own elasticity, and therefore, the core can be caught by the supporting device.

The above-described conventional core and supporting device, however, have several disadvantages as follows:

(a) The resilient tabs of the supporting device are so small that the flexible ranges of the tabs are very narrow. Therefore, strong force must be exerted on the core to attach it to the supporting device.

(b) When the core is removed from the tabs after the label strip on the core is used up, the core must be forcibly pulled with twisting, so that the tabs are often damaged. In addition, such operation gives the worker uneasy and unpleasant feeling.

(c) When the attaching and detaching of cores are repeated in the use of a label printing and applying machine for a long period of time, the elasticity of tabs is deteriorated and the core supporting force becomes weak, so that the supported rolled label strip often slips off during the use of the machine.

(d) In order to facilitate the attaching and detaching of cores, the surfaces of engaging projections of the tabs must be made smooth, however, from this viewpoint, the core of rolled label strip becomes liable to slip off from the supporting device.

BRIEF SUMMARY OF THE INVENTION

In view of the above-described facts, the present invention has been made so as to improve the attaching and detaching operation of the cores carrying rolled label strips.

Therefore, the primary object of the present invention is to provide an improved core for a rolled label strip which can be easily attached to a supporting device without requiring any strong force.

Another object of the present invention is to provide a core for a rolled label strip which can be easily disengaged from the supporting device causing neither damage to the supporting device nor the uneasy feeling to operators.

A further object of the present invention is to provide a core for a rolled label strip which can be firmly attached to the supporting device and is not released unexpectedly during the use of a label printing and applying machine.

In accordance with the characteristic feature of the present invention, the core for supporting a rolled label strip is cylindrical and comprises: an attaching section, raised faces, fitting recesses, ribs and a plurality of grooves. The attaching section is formed in a first end face on one side of the cylindrical core body and provided with an inner bore having a diameter smaller than the inner diameter of the cylindrical body. The raised faces are formed on the first end face and the fitting recesses are formed on a second end face on the other side of the cylindrical body. The raised faces of a core are brought into engagement with the fitting recesses of another adjacent core when the cores are arranged on a mandrel in the label slitting and winding work. The above mentioned ribs are formed on the inner wall surface of the cylindrical body in the direction parallel to the axis of the cylindrical body and the height of the ribs is made the same as the level of the inner surface of the above-mentioned inner bore. In the label slitting and winding work, these ribs come into contact with the mandrel that is supporting the cores. The above mentioned grooves of the core are formed in the inner wall surface of the cylindrical body in the direction parallel to the axis of the cylinder. The depth of the grooves is so made as to leave a small thickness of the cylindrical body and, when the cylindrical body is pinched with fingers after the rolled label strip is used up, the cylindrical body can be easily split into several pieces to be disengaged from the supporting device.

The supporting device for supporting the core of the present invention carrying a rolled label strip, comprises a rotary member which holds a pair of engaging members each having an acute-angled engaging pawl. The engaging members are urged outward by a spring member so as to engage with the attaching section of the above-described core of the present invention.

With the above-described core and supporting device of the present invention, the foregoing disadvantages caused to occur in the conventional cores and supporting devices can be eliminated and the above objects of the present invention can be successfully attained.

BRIEF DESCRIPTION OF THE DRAWINGS

In order that the invention may be more fully understood, preferred embodiments and various supplementary features will now be described by way of example and with reference to the accompanying drawings, in which.

DETAILED DESCRIPTION OF PREFERRED EMBODIMENTS

Referring to the accompanying drawings, the preferred embodiments of the present invention will be described in more detail in comparison with the conventional ones.

Figure 1:
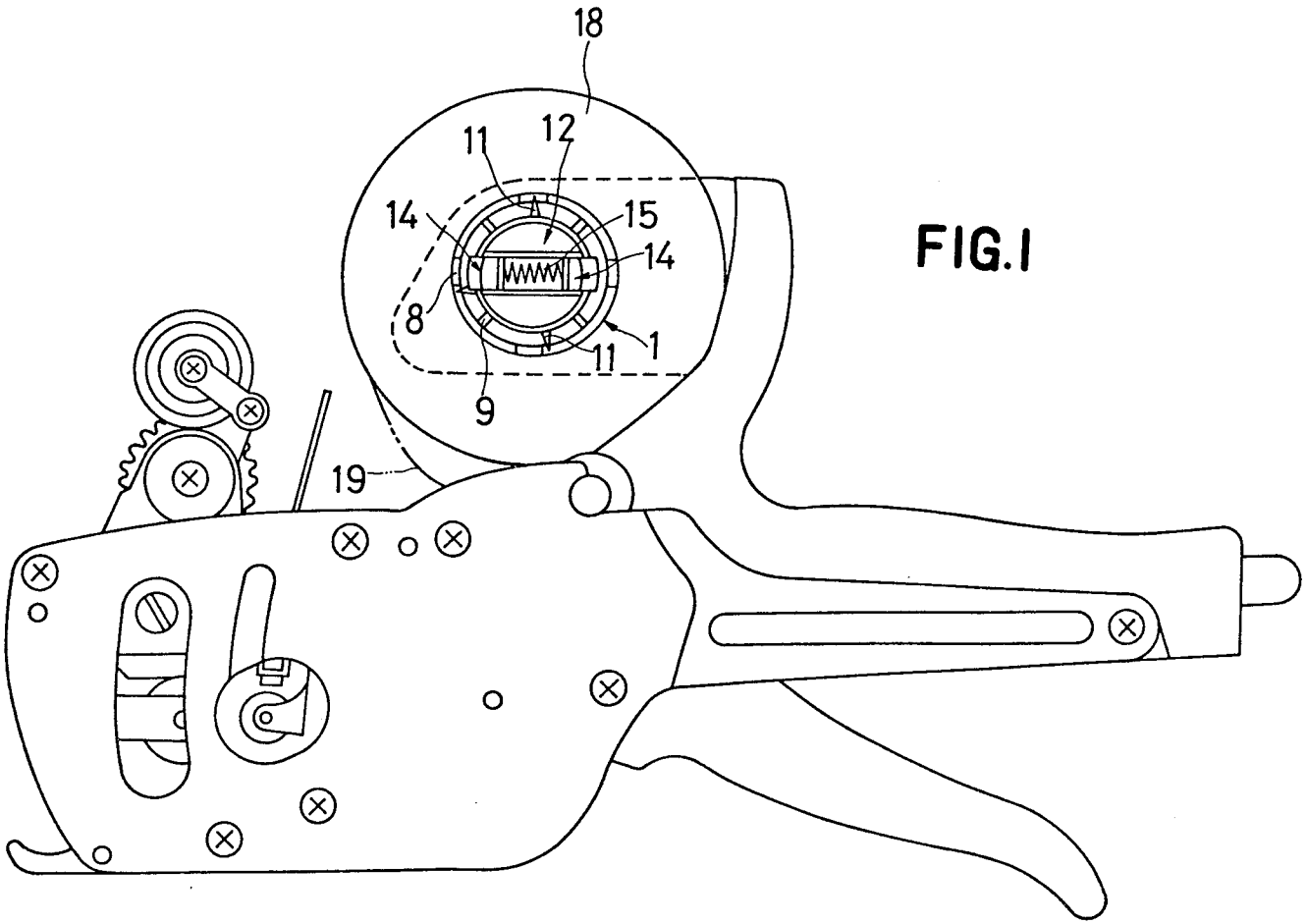
FIG. 1 is a side view of a label printing and applying machine, to which the improved core of the present invention is attached.
Figure 3:
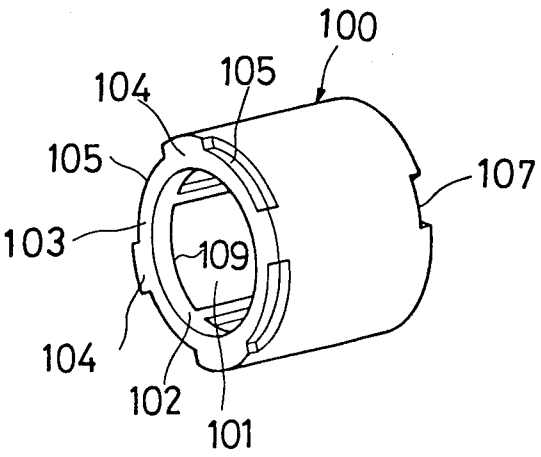
FIG.3 PRIOR ART
FIG. 3 is also a perspective view of the same core in the conventional art as that shown in FIG. 2, which is taken from the side of the core including the attaching section.
Figure 2:
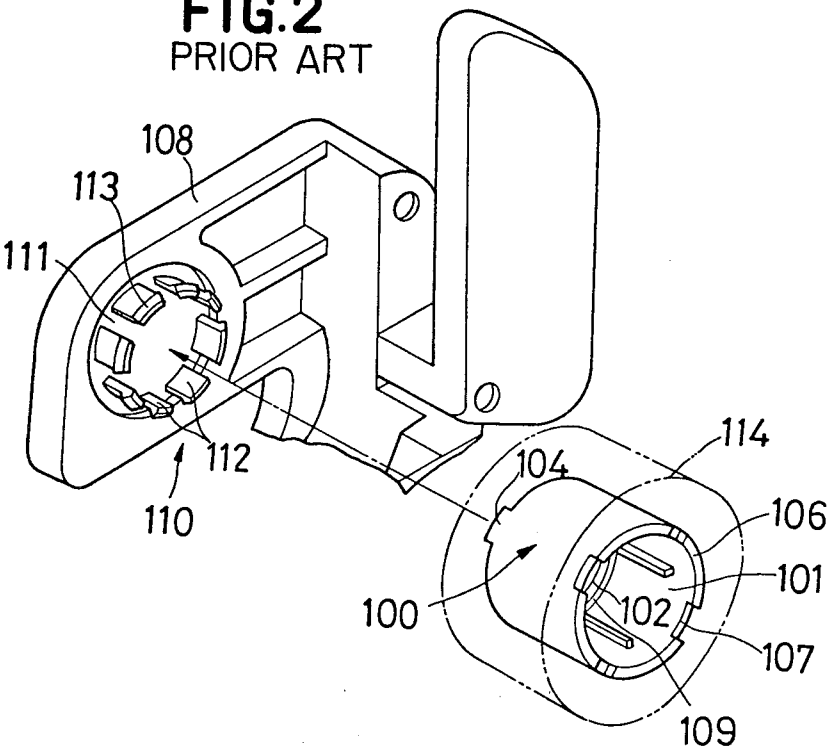
FIG.2 PRIOR ART
FIG. 2 is a perspective view of a core and a core supporting device of a conventional label printing and applying machine.

In FIG. 2 and FIG. 3, there are shown typical examples of a conventional core for a rolled label strip and a core supporting device for supporting the core. The core 100 is of cylindrical shape and has a circular attaching section 102 on one side thereof, the inner diameter of which section is made smaller than that of the inner wall surface 101 of the cylindrical body. On the periphery of one end face 103 are formed a plurality of raised faces 104 and arcuate recesses 105 in adjoined alternating relation to one another. On the other end face 106, a plurality of annularly spaced apart recesses 107 are formed. The recesses 107 are brought into engagement with the above-mentioned raised faces 104 of another core 100 when a number of cores 100 are aligned on their axis in the label slitting and core winding operation. Thus the ajoined cores 100 can be rotated altogether and the idling of each core 100 is avoided.

In the core supporting device 110, a core supporting member 111 is rotatably fitted to an arm plate 108 that is formed on a label printing and applying machine. The inside surface of the core supporting member 111 is provided with a plurality of resilient tabs 112 which are arranged on a circle in a standing posture. Each resilient tab 112 is provided on its outer side with a ridge-shaped engaging projection 113. The diameter of the circle obtained by connecting these engaging projections 113 is made somewhat larger than the inner diameter of the attaching section 102 of the above-described core 100.

As shown in FIG. 2, the inner circular edges of one side face 103 of the core 100 having a rolled label strip 114 thereon, is fitted to the resilient tabs 112 of the supporting device 110, and the core 100 is then pushed forth. With this operation, the inner surface of the attaching section 102 of core 100 rides over the engaging projections 113 of the resilient tabs 112 and the tabs 112 are bent inward. After this action, the resilient tabs 112 restore their original postures by their own elasticity to hold the core 100. In this, the rear side 109 of the attaching section 102 of core 100 is brought into engagement with the inclined surfaces on the insides of the engaging projections 113 of the resilient tabs 112. Therefore, the core 100 can be caught by the supporting device 110.

As described in the foregoing paragraph, the above conventional core and supporting device are defective in that the attaching and detaching of the core are not easy and the engaging tabs are liable to be damaged. In addition, the elasticity of tabs are deteriorated in long term use.

In view of the above-described facts, the present invention has been made so as to improve the attaching and detaching operations of cores and to prevent the core from undesired disengaging in the use of a label printing and applying machine. The embodiments of the present invention will now be described.

As shown in FIGS. 4 to 7, the core 1 of the present invention is also of cylindrical shape. The first end face 4 of the core 1 is made wider in the radial direction than the other second end face 3. On the rear side of the first end face 4 is formed an engaging surface 5. Between the first end face 4 and the engaging surface 5 is an inner bore 2 which is coaxial with the cylindrical core body and has a smaller diameter than that of the cylindrical core body. An attaching section 10 is formed with the above-described first end face 4, the engaging surface 5 and the inner bore 2. On the periphery of the first end face 4, arcuate recesses 6 for preventing idle rotation are symmetrically formed, and the remaining portions of the first end face 4 are provided with raised faces 7 usable during core winding.

The second end face 3 on the other side is provided with fitting recesses 8 which and receives the raised faces 7 of another core 1 of the same shape. This occurs during a core winding work. On the inner wall surface of the cylindrical body, a plurality of ribs 9 for engaging with a mandrel are integrally formed. Each rib 9 is arranged in parallel to the axis of the cylindrical body and has the same height as the inner surface of the above-mentioned inner bore 2.

Generally in a label manufacturing factory, the core winding work, more particularly, label slitting the winding of a label strip on a core is carried out by inserting a mandrel (not shown) into the bores 2 of a plurality of cores 1 and winding tape-like label strips 19 around the respective cores 1 to define the wound rolls 18. In this operation, since the cores 1 are firmly secured to the mandrel through the provision of the ribs 9 on the inner wall surfaces of cores 1, the rattling or play of cores 1 relative to the mandrel can be prevented. Further, since the raised faces 7 of the cores 1 are brought into engagement with the recesses 8 of adjacent cores 1, the cores 1 are rotated together as one body without causing individual idling. Therefore, the label core 1 having the above structure is quite advantageous for improving the workability of the slitting and winding work of tape-like label strips 19.

Figure 4B:
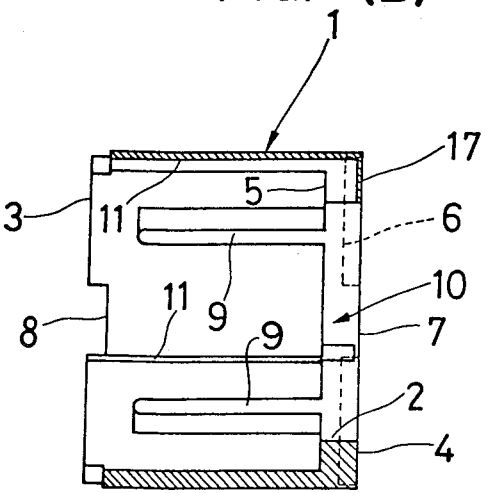
FIG. 4(B) is a vertical cross-sectional view of the core shown in FIG. 4(A), taken on the line IV—IV in FIG. 4(A)
Figure 4A:
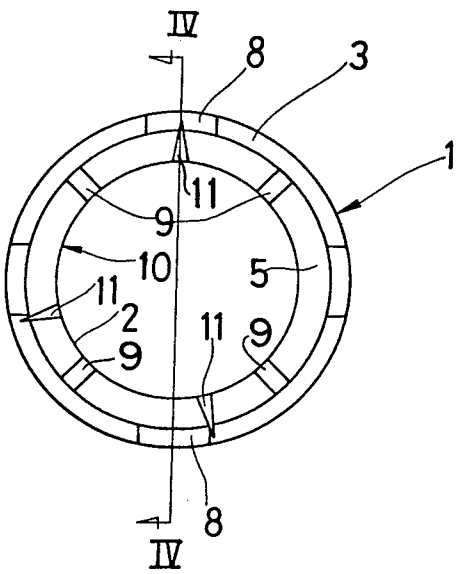
FIG. 4(A) is a rear side view of the first embodiment of the core of the present invention.
Figure 6:
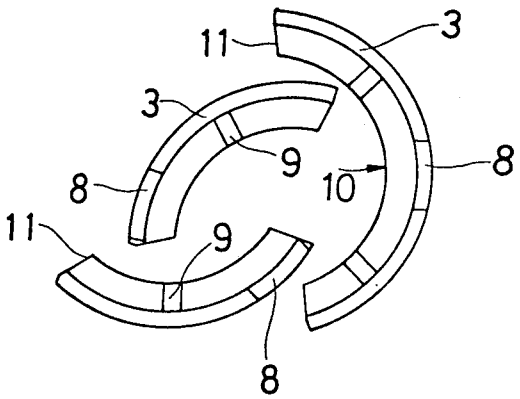
FIG. 6 is rear side view of the core shown in FIGS. 4(A) and 4(B), which is split into three pieces along the grooves of the core.

In the core 1 of the present invention, a plurality of cross-sectionally V-shaped grooves 11 are formed in the inner wall surface of the cylindrical body in parallel to the axis of the cylindrical body. The embodiment as shown in FIG. 4 is provided with three V-shaped grooves 11. However, the number of such grooves is not restricted to three. The purpose of the provision of the grooves 11 is that, when the core 1 is disengaged from the supporting device, the core 1 can be easily split along the V-shaped grooves 11 by pressing a portion of the outer surface with a finger, and it becomes the state as shown in FIG. 6.

Figure 5:
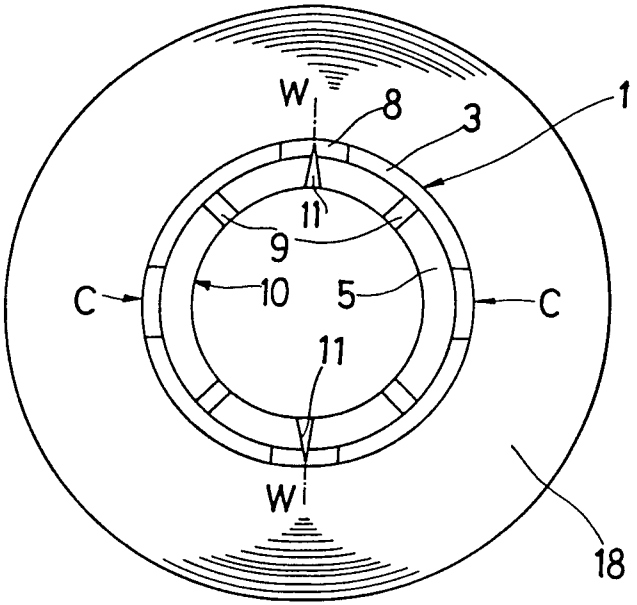
FIG. 5 is a rear side view of the second embodiment of the core of the present invention.

In the embodiment shown in FIG. 5, the V-shaped grooves 11 are formed at two positions to bisect the girth of the core 1. This core 1 has the advantage in molding that, when it is molded with using a plastic material by injecting the fused material from the points C on both sides of the core 1, weld lines W are formed just along the V-shaped grooves 11. Thus the splitting of the core 1 can be made easier by the provision of such weld lines.

Figure 7:
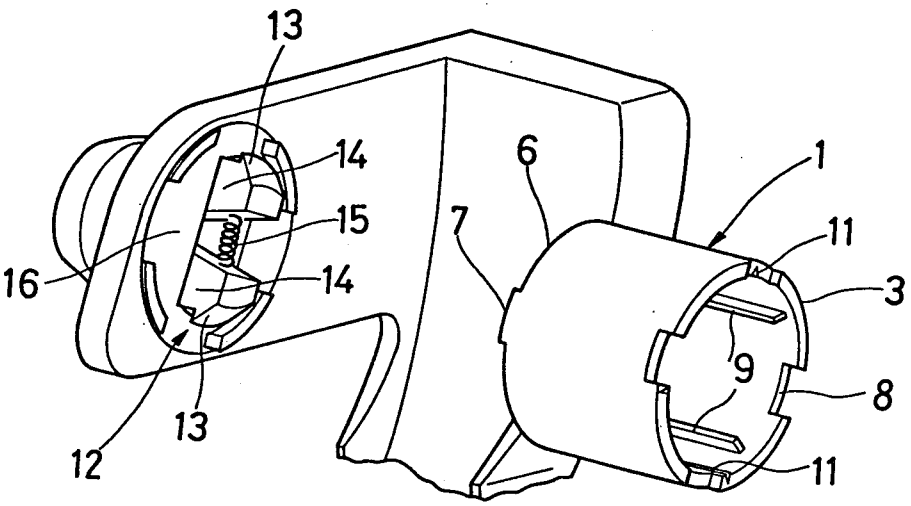
FIG. 7 is a perspective view of the core shown in FIG. 4 and an improved core supporting device.

Since the core of the present invention can be easily split as described above, the mechanism of the supporting device of a label printing and applying machine is also changed. As shown in FIG. 7, the supporting device 12 comprises a rotary member 16 which holds a pair of engaging members 14 each having an acute-angled engaging pawl 13. The engaging members 14 are urged outward by an engagement spring 15.

Accordingly, the core 1 can be caught by the force of a spring 15 which is different from the conventional supporting devices 110 which support cores by the resiliency of the tabs 112. With the above structure of the present invention, the core 1 can be attached to the supporting device with relatively weak force of pushing. Further, the core 1 can be supported firmly and reliably since the engaging pawls 13 are made acute-angled shape. Still further, when the rolled label strip has been used up and the core 1 is detached, the core 1 can be split quite easily with weak force without the necessity of pulling and twisting the core for it to be removed from the pawls 13.

It should be noted that the cross-sectional shape of the above-described groove 11 is not restricted to the V-shape. Further, one end of the groove 11 does not reach the first end face 4 forming a remained portion 17. However, when the groove 11 is made as a through groove passing from one end face to the other end face, the core can be split more easily.

As described above, the core and the core supporting device of the present invention have the following advantages.

(a) When a core is disengaged from the supporting device, the core can be easily split by slight pinching force without causing any unpleasant feeling.

(b) Since the supporting device is improved in its structure, the attaching of a core can be attained easily and quickly, while the core can be firmly supported by the acute-angled engaging pawls. Further, the rolled label strip can be prevented from unexpected disengaging in the use of a label printing and applying machine.

(c) If the positions of the ribs 9 of a core 1 coincide with the positions of engaging pawls 13 of the supporting device, the engaging surface 5 of the core 1 is not caught by the engaging pawls 13, so that these positions must be moved aside from each other. However, when the grooves 11 are formed in suitable positions, the attaching of core can be carried out by using the grooves 11 as setting marks.

(d) Since the core is divided apart into pieces after the label strip is used up, the volume of the core can be much reduced as compared with its volume when it was still a cylindrical body. Therefore, it can be easily discarded.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A cylindrical core for supporting a rolled label strip thereon and for being detachably attached to the core supporting device of a label printing and applying machine or the like, the core for a rolled label strip comprising:

a cylindrical core body having an inner wall surface having an inner diameter; an attaching section formed in a first end face on one side of said cylindrical core body; said attaching section being provided with an inner bore passing therethrough and said inner bore having a diameter smaller than said inner diameter of said cylindrical body;

raised faces formed on said first end face;

a second end face on the other side of said cylindrical body; fitting recesses formed on said second end face;

ribs adapted for being fitted to a mandrel, said ribs being formed on said inner wall surface of said cylindrical body and said ribs extending in the direction parallel to the axis of said cylindrical body, the height of said ribs being the same as the diameter of said inner bore; and a plurality of grooves formed in said inner wall surface of said cylindrical body in the direction parallel to the axis of said cylindrical body.

2. The core for a rolled label strip as claimed in claim 1, wherein the cross-sections of said grooves is of V-shape.

3. The core for a rolled label strip as claimed in claim 1, wherein the depth of each said groove is so made as to leave a small thickness of said cylindrical body whereby when said cylindrical body is pinched with fingers after the rolled label strip is used up, said cylindrical body can be easily split into pieces to be disengaged from said supporting device.

4. A core for supporting a rolled strip of labels thereon, said core comprising:

a hollow cylindrical body with opposite first and second ends; said body having an interior wall and an external peripheral wall; an attaching section formed at said first end of said core, including means for attaching said core to a label strip core supporting device;

at least one groove in said body interior wall extending parallel to the axis of said cylindrical body for weakening said body to facilitate breaking thereof at said at least one groove.

5. The core of claim 4, wherein the cross section of said at least one groove is of V-shape, with the V tapering narrower toward said body external wall.

6. The core of claim 4, wherein said at least one groove has a depth such that a small thickness of the material of said cylindrical body remains beyond said groove at and inwardly from said body external wall, and when said cylindrical body is pinched following removal of a rolled strip of labels therefrom, said cylindrical body being adapted to be split into pieces at said at least one groove, thereby to be disengaged from a label strip supporting device.

7. The core of claim 6, wherein the cross section of said at least one groove is of V-shape, with the V tapering narrower toward said body external wall.

8. The core of claim 6, wherein said core has an end face at said first end thereof; said attaching section being formed at said first end face; said attaching section comprising a reduced internal diameter portion of said cylindrical body with said attaching section portion extending radially inwardly from said cylindrical body external wall and being radially thicker than the remainder of said cylindrical body; said attaching section including an inner bore having an inner diameter smaller than the diameter of said cylindrical body internal wall.

9. The core of claim 8, wherein said cylindrical body includes a second end face at said second end of said cylindrical body; raised surfaces on one of said end faces being provided for engaging recesses on an end face of an adjacent core; fitting recesses on the oppposite one of said end faces of said cylindrical body for receiving raised surfaces of an adjacent core;

ribs adapted for being fitted to a mandrel and being formed on and projecting radially inwardly from said internal wall of said cylindrical body; said ribs extending in a direction parallel to the axis of said cylindrical body and being annularly offset from said at least one groove; the height of said ribs being the same as said inner diameter of said attaching section inner bore.

10. The core of claim 4, wherein said at least one groove extends the full axial length of said cylindrical body, except for a short axial length section of said body at said first end of said core through which said groove does not extend.

11. The core of claim 4, wherein there are a plurality of said grooves arrayed at spaced intervals around said body internal wall.

12. The core of claim 11, wherein the cross section of each said groove is of V-shape, with the V tapering narrower toward said body external wall.

13. In combination, the core of claim 12 and a label strip roll; said roll being wound on said core, and being unwindable therefrom.

14. The core of claim 11, wherein all said grooves extend the full axial length of said cylindrical body, except for a short axial length section of said body at said first end of said core through which said grooves do not extend.

15. The core of claim 11, wherein said cylindrical body includes a second end face at said second end of said cylindrical body; raised surfaces on one of said end faces being provided for engaging recesses on an end face of an adjacent core; fitting recesses on the opposite one of said end faces of said cylindrical body for receiving raised surfaces of an adjacent core;

ribs adapted for being fitted to a mandrel and being formed on and projecting radially inwardly from said internal wall of said cylindrical body; said ribs extending in a direction parallel to the axis of said cylindrical body and being annularly offset from said at least one groove.

16. The core of claim 15, wherein said core has an end face at said first end thereof; said attaching section being formed at said first end face; said attaching section comprising a reduced internal diameter portion of said cylindrical body with said attaching section portion extending radially inwardly from said cylindrical body external wall and being radially thicker than the remainder of said cylindrical body; said attaching section including an inner bore having an inner diameter smaller than the diameter of said cylindrical body internal wall;

the height of said ribs being the same as said inner diameter of said attaching section inner bore.

17. The core of claim 11, wherein said core has an end face at said first end thereof; said attaching section being formed at said first end face; said attaching section comprising a reduced internal diameter portion of said cylindrical body with said attaching section portion extending radially inwardly from said cylindrical body external wall and being radially thicker than the remainder of said cylindrical body; said attaching section including an inner bore having an inner diameter smaller than the diameter of said cylindrical body internal wall; the height of said ribs being the same as the inner diameter of said attaching section inner bore.

18. In combination, the core of claim 17, and a label strip core supporting device; said supporting device comprising a supporting arm and an array of fingers carried on said supporting arm and shaped and positioned to be fitted in said attached section bore of said core;

means for urging said fingers outwardly; said fingers being so spaced apart and being so located as to be squeezed together as they are passed through said attaching section bore, and also being so spaced apart and located as to move apart once they have passed said attaching section bore, thereby to securely hold said core on said supporting device by means of said attaching section.

19. In combination, the core of claim 11, and a label strip core supporting device; said supporting device comprising a supporting arm and an array of fingers carried on said supporting arm and shaped and positioned to be fitted into said attaching section bore of said core.

20. The combination of claim 19, wherein the cross section of each said groove is of V-shape, with the V tapering narrower toward said body external wall.

21. In combination, the combination of claim 20 and a label strip roll; said roll being wound on said core, and being unwindable therefrom.

22. In combination, the core of claim 11 and a label strip roll; said roll being wound on said core, and being unwindable therefrom.

* * * * *